US007114321B2

(12) United States Patent
Belsom et al.

(10) Patent No.: US 7,114,321 B2
(45) Date of Patent: Oct. 3, 2006

(54) THERMAL ISOLATION DEVICE FOR LIQUID FUEL COMPONENTS

(75) Inventors: Keith Cletus Belsom, Laurens, SC (US); Michael Damian Seal, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 507 days.

(21) Appl. No.: 10/631,028

(22) Filed: Jul. 31, 2003

(65) Prior Publication Data

US 2005/0022530 A1 Feb. 3, 2005

(51) Int. Cl.
*F02G 3/00* (2006.01)
*F02C 1/00* (2006.01)

(52) U.S. Cl. ..... 60/39.091; 60/741; 60/796

(58) Field of Classification Search ..... 60/39.091, 60/739–741, 796, 800; 431/171; 126/1 F, 126/709

See application file for complete search history.

(56) References Cited

U.S. PATENT DOCUMENTS

| | | | | |
|---|---|---|---|---|
| 2,690,462 | A * | 9/1954 | Duckwall | 136/228 |
| 3,615,054 | A | 10/1971 | Botz | |
| 3,771,595 | A | 11/1973 | Slaasted | |
| 4,422,300 | A * | 12/1983 | Dierberger et al. | 60/757 |
| 4,502,461 | A * | 3/1985 | Keating | 126/39 K |
| 4,749,029 | A * | 6/1988 | Becker et al. | 165/47 |
| 5,174,714 | A | 12/1992 | Plemmons et al. | |
| 5,211,005 | A * | 5/1993 | Hovnanian | 60/800 |
| 5,562,408 | A | 10/1996 | Proctor et al. | |
| 5,697,213 | A * | 12/1997 | Brewer et al. | 60/766 |
| 6,092,361 | A | 7/2000 | Romani | |
| 2003/0010033 | A1 | 1/2003 | Buca et al. | |

FOREIGN PATENT DOCUMENTS

| | | |
|---|---|---|
| GB | 441674 | 1/1936 |
| GB | 1411110 | 10/1975 |
| GB | 2216643 | 10/1989 |

* cited by examiner

*Primary Examiner*—Charles G. Freay
(74) *Attorney, Agent, or Firm*—Nixon & Vanderhye P.C.

(57) ABSTRACT

A thermal isolation device for a gas turbine combustor assembly includes a plurality of substantially flat plates secured in spaced relationship by a plurality of columns, at least one column incorporating a bolt hole for use in securing the device between a pair of combustor components.

14 Claims, 3 Drawing Sheets

THERMAL ISOLATION DEVICE FOR LIQUID FUEL COMPONENTS

BACKGROUND OF THE INVENTION

This invention relates to land based gas turbines used for power generation and, specifically, to a device that protects liquid fuel from convective, conductive and radiation heat transfer loads.

It has been found that heat loading into the fuel components of the gas turbine engine are sufficient to form coke within the components, resulting in loss of turbine performance. The inventors are aware of no prior attempts to solve this problem.

BRIEF DESCRIPTION OF THE INVENTION

This invention relates to a device that is designed to provide an increase in thermal resistance between the gas turbine liquid fuel system components and one of the primary heat sources, thus providing a reduction in heat transfer into the fuel component that leads to increased operational performance of those components.

In the exemplary embodiment, the thermal isolation device includes an assembly of three thin, flat cylindrical columns and three plates. The columns provide structural support for the isolation device and the liquid fuel system components that are attached to the isolation device. The flat plates, arranged substantially perpendicularly to the columns and spaced from each other along the axes of the columns, provide desired surface area for convective cooling. The three plates are spaced equidistantly from one another, and the number of plates may vary. The device is adapted for integration with a gas turbine combustor assembly, for example, between the combustor end cover and the liquid fuel distributor valve.

The height of the isolation device is sized to provide adequate increase in conductive path length for increased thermal resistance. The plates are sized to be as large as possible so as to provide maximum surface area for cooling as well as to provide the maximum shielding of radiation heat loading from the end cover to the liquid fuel distributor valve, while being limited by geometric restrictions due to adjacent componentry on the current combustion end cover assembly and the limitations of additional structural concerns due to vibration.

Accordingly, in one aspect, the present invention relates to a thermal isolation device for a gas turbine combustor assembly comprising a plurality of substantially flat plates secured in spaced relationship by a plurality of columns, at least one column incorporating a bolt hole for use in securing the device between a pair of combustor components.

In another aspect, the invention relates to a thermal isolation device for a gas turbine combustor assembly comprising at least three substantially flat and substantially triangular-shaped plates secured in spaced, substantially parallel relationship to at least three columns.

The invention will now be described in connection with the drawings identified below.

DETAILED DESCRIPTION OF THE INVENTION

Figure 1:
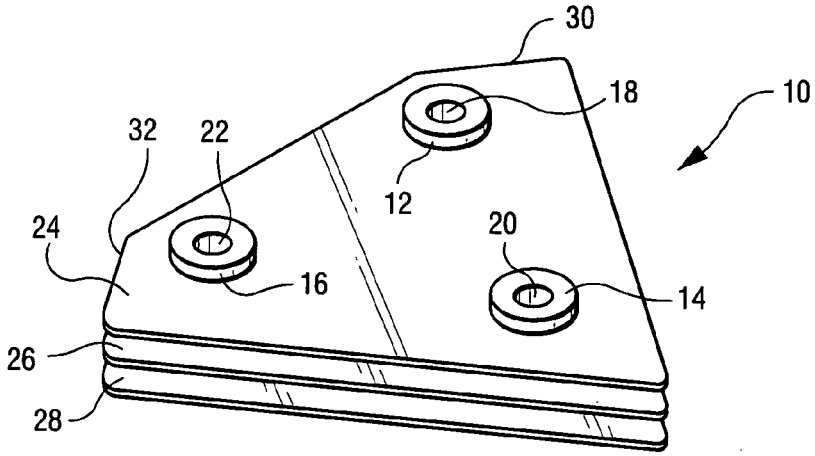
FIG. 1 is a perspective view of a thermal isolation device in accordance with an exemplary embodiment of the invention.
Figure 2:
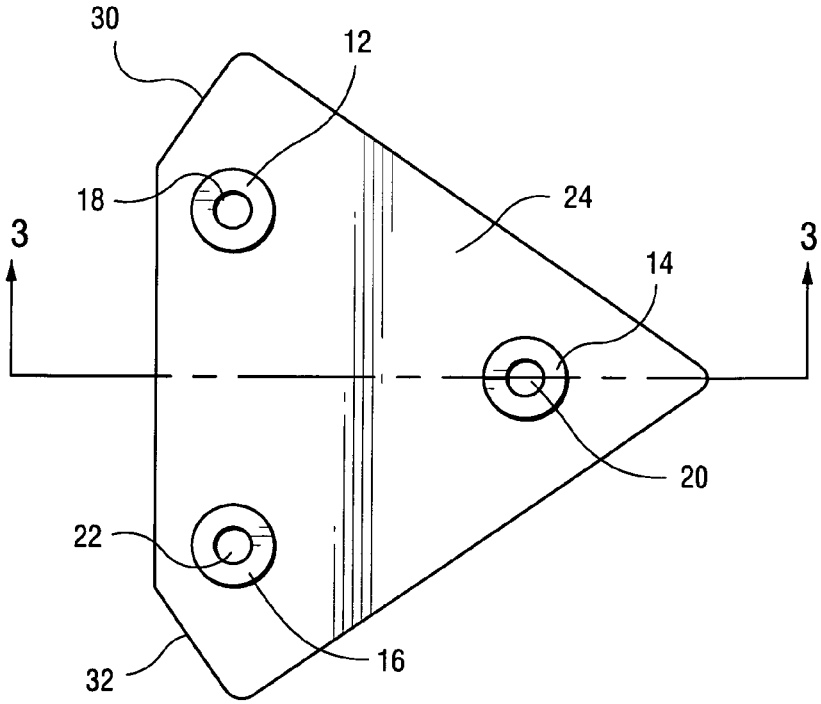
FIG. 2 is a plan view of the device shown in FIG. 1.
Figure 3:
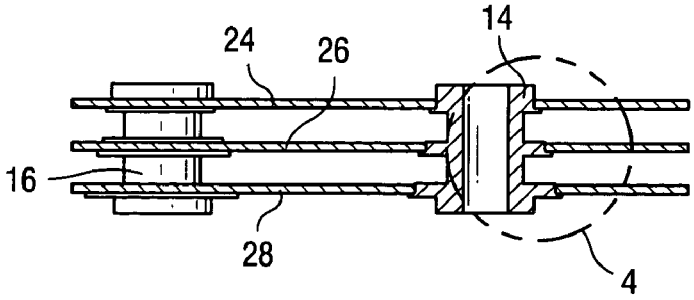
FIG. 3 is a section taken along the line 3–3 of FIG. 2.

With reference initially to FIGS. 1–3, the thermal isolation device 10 is constructed of three discrete columns 12, 14 and 16, each formed with respective through holes (or bolt holes) 18, 20 and 22. A plurality of flat plates 24, 26 and 28 are secured to the columns in axially spaced relationship, i.e., axially spaced along the longitudinal axes of the columns.

The three cooling plates 24, 26 and 28 are approximately 0.100 inches in thickness, and their plan view geometry is approximately triangular, with truncated corners at 30, 32. The cooling plates 24, 26 and 28 generate a maximum footprint or coverage on the end cover, limited only by structural vibration concerns.

Figure 4:
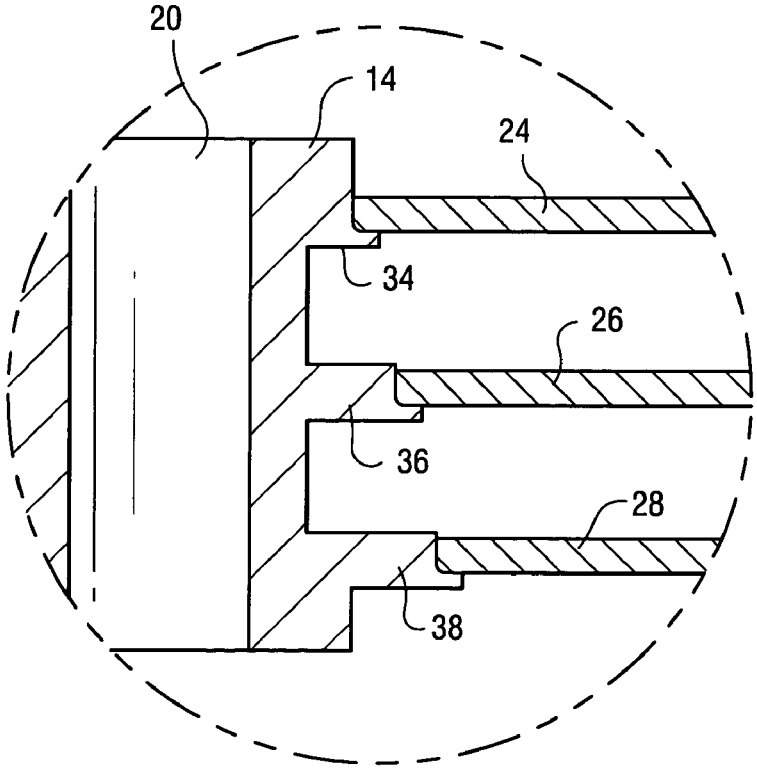
FIG. 4 is an enlarged detail taken from FIG. 3.

The plates 24, 26 and 28 are secured, by brazing for example, to respective radial flanges 34, 36 and 38, best seen in FIG. 4. The diameters of the flanges increase from top to bottom (in the orientation shown in FIGS. 3 and 4) facilitating brazing of the plates to the columns.

The length or height of the columns 12, 14 and 16 is determined so as to provide increased conduction length and hence less heat transfer into the liquid fuel distributor valve 40 from the combustion end cover 42. In the exemplary embodiment, the thermal isolation device 10, including the columns and plates, is made of stainless steel.

Figure 5:
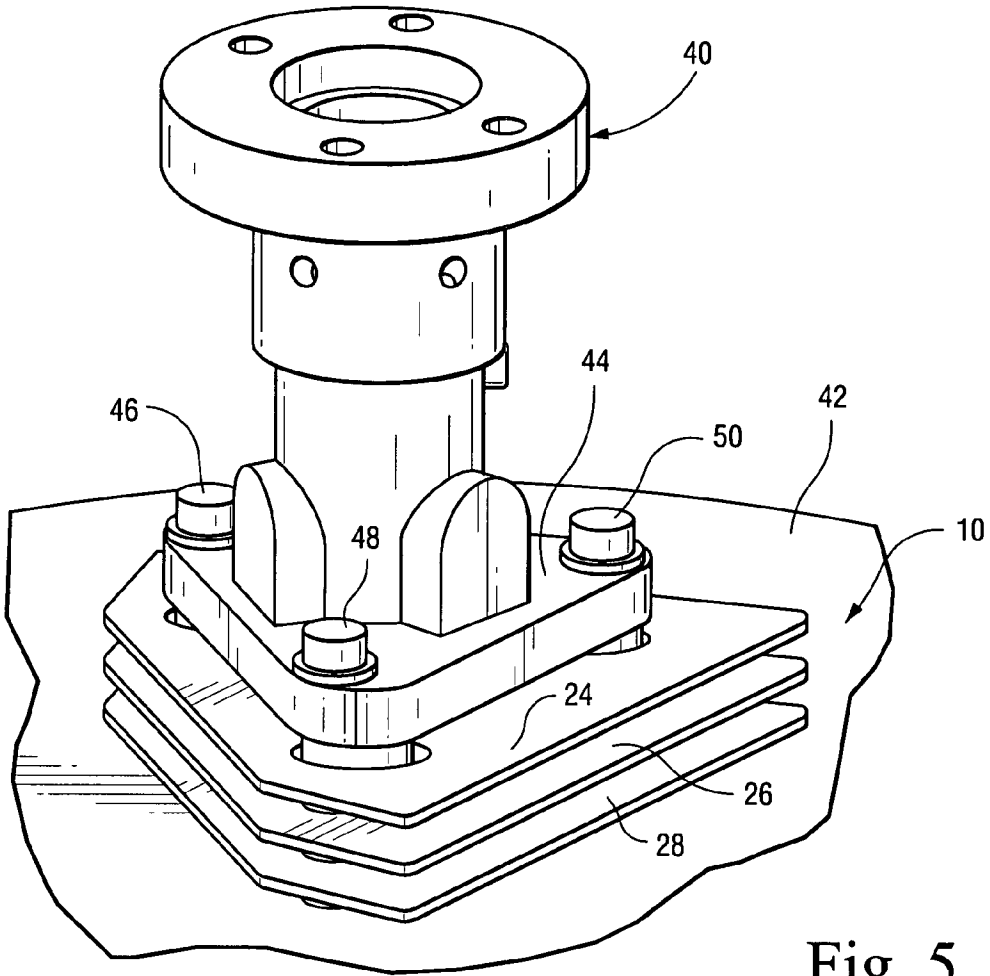
FIG. 5 is a perspective view of the thermal isolation device as shown in FIG. 1 in combination with a liquid fuel distributor valve.

The columns 12, 14 and 16 are arranged so as to accommodate the mounting flange and bolt pattern of the liquid fuel component parts. In the exemplary embodiment, the component parts include a liquid fuel distributor valve 40 best seen in FIG. 5. In this way, the device 10 can be mounted between the mounting flange 44 of the liquid fuel distributor valve 40 and the combustion end cover 42 and secured by bolts 46, 48 and 50 without modification to either of the fuel component parts. With this arrangement, the large planform area of the thermal isolation device 10 provides shielding of radiation modes from the end cover 42. At the same time, cooling air flowing between the plates 24, 26 and 28 at temperatures of 250–275 ° F. will provide a cooling benefit to the liquid fuel distributor valve 40 and the fuel flowing through the valve. It is expected that the fuel temperature may drop by about 50° F.

It will be appreciated that the triangular shape of the plates is dictated to a large extent by the shape of the mounting flange or other surface of the fuel component to which it is to be attached and its associated bolt pattern. Both the shape and number of plates may vary, depending on specific applications. For example, for a square mounting flange on a distributor valve with a four bolt pattern, the device 10 could be modified to include square plates and four columns arranged to match the four bolt pattern.

The main advantage of a thermal isolation device 10 is an increase in thermal resistance resulting in a sufficient reduction and operational temperatures of the liquid fuel distributor valve so as to lower the liquid fuel temperature and thus result in higher operational efficiency. The isolation device 10 is designed to be an addition to a current system, but requires only minimal changes to the existing components such as fuel tubes, etc.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine combustor assembly comprising a thermal isolation device having a plurality of substantially flat plates secured in spaced relationship to a plurality of columns, at least one column incorporating a bolt hole, and a bolt extending through the bolt hole and securing the device between a pair of combustor components.

2. The assembly of claim 1 wherein said plurality of substantially flat plates comprises three plates.

3. The assembly of claim 1 wherein said plurality of columns comprises three columns.

4. The assembly of claim 1 having a height dimension of about 1.5 inches.

5. The assembly of claim 1 wherein each of said plurality of plates has a thickness of about 0.100 inches.

6. The assembly of claim 1 wherein said plates and columns are constructed of stainless steel.

7. The assembly of claim 1 wherein said plurality of plates are each substantially triangular in shape.

8. The assembly of claim 1 wherein said plurality of plates are held in substantially parallel relationship and spaced substantially equally from each other along longitudinal axes of said columns.

9. The assembly of claim 1 wherein said columns are arranged in such a manner that the thermal isolation device can be inserted between the pair of combustor components using existing bolt hole patterns in the combustor components.

10. A thermal isolation device for a gas turbine combustor assembly comprising at least three dicrete substantially flat and substantially triangular-shaped plates secured in spaced, substantially parallel relationship to at least three columns, that pass through said plated, each column formed with a through hole adapted to receive a bolt.

11. The thermal isolation device of claim 10 having a height dimension of about 1.5 inches.

12. The thermal isolation device of claim 10 wherein each of said plurality of plates has a thickness of about 0.100 inches.

13. The thermal isolation device of claim 10 wherein said plates and columns are constructed of stainless steel.

14. The thermal isolation device of claim 10 wherein said columns each incorporate a bolt holes, and said columns are arranged in such a manner that the thermal isolation device can be inserted between the pair of combustor components using existing bolt hole patterns in the combustor components.

* * * * *

UNITED STATES PATENT AND TRADEMARK OFFICE

CERTIFICATE OF CORRECTION

PATENT NO. : 7,114,321 B2
APPLICATION NO. : 10/631028
DATED : October 3, 2006
INVENTOR(S) : Belsom et al.

It is certified that error appears in the above-identified patent and that said Letters Patent is hereby corrected as shown below:

In the Claims:

Claim 10, line 2, delete “dicrete” and insert --discrete--.

Claim 10, line 5, delete “plated” and insert --plates--.

Claim 14, line 2, delete “holes” and insert --hole--.

Signed and Sealed this

Twenty-sixth Day of December, 2006

JON W. DUDAS
*Director of the United States Patent and Trademark Office*